US011369235B1

(12) United States Patent
Kaiser et al.

(10) Patent No.: US 11,369,235 B1
(45) Date of Patent: Jun. 28, 2022

(54) DISPENSING BOTTLE

(71) Applicant: Erik A. Kaiser, New York, NY (US)

(72) Inventors: Erik A. Kaiser, New York, NY (US); Joshua David Kran, Endwell, NY (US)

(73) Assignee: Erik A. Kaiser, New York, NY (US)

( * ) Notice: Subject to any disclaimer, the term of this patent is extended or adjusted under 35 U.S.C. 154(b) by 0 days.

(21) Appl. No.: 17/359,580

(22) Filed: Jun. 27, 2021

Related U.S. Application Data

(63) Continuation-in-part of application No. 29/776,895, filed on Apr. 1, 2021.

(51) Int. Cl.
*A47K 5/12* (2006.01)
*B65D 47/00* (2006.01)

(52) U.S. Cl.
CPC ..... *A47K 5/1205* (2013.01); *B65D 47/00* (2013.01)

(58) Field of Classification Search
CPC ..... A47K 5/1205; B65D 47/00
USPC ..... 222/402, 402.11, 153.13, 321.1, 222/321.7–321.9
See application file for complete search history.

(56) References Cited

U.S. PATENT DOCUMENTS

| | | | | |
|---|---|---|---|---|
| 4,320,859 | A * | 3/1982 | Shy | B67D 1/0425 222/536 |
| 8,181,831 | B2 * | 5/2012 | Chapin | B05B 11/0037 222/321.5 |
| 9,725,296 | B2 * | 8/2017 | Taylor | F04D 13/086 |
| 10,595,685 | B2 * | 3/2020 | Falcon | B05B 11/3056 |
| 2014/0117052 | A1 * | 5/2014 | Garrison | B05B 11/0037 222/153.13 |

* cited by examiner

*Primary Examiner* — Lien M Ngo
(74) *Attorney, Agent, or Firm* — Steven N. Fox, Esq.

(57) ABSTRACT

Disclosed is a dispensing bottle for storing and dispensing a fluid medium. The dispensing bottle comprises a container comprising a cavity for storing the fluid medium. The dispensing bottle further comprises a cap engaged with the container. The cap comprises a first portion and a second portion comprising a top surface disposed above the first portion. The dispensing bottle further comprises a pump engaged with the first portion of the cap and substantially disposed within the cavity. The dispensing bottle further comprises a spout engaged with the pump and extending outside of the cap. The spout being moveable between an open position where the spout extends away from the cap so the fluid medium may be dispensed and a closed position where the spout is disposed slightly above or in contact with the top surface of the second portion of the cap to prevent downward movement of the spout.

5 Claims, 6 Drawing Sheets

DISPENSING BOTTLE

CROSS-REFERENCE TO RELATED APPLICATIONS

This application claims the benefit of and priority to and is a continuation-in-part of U.S. Design application Ser. No. 29/776,895 filed on Apr. 1, 2021, now pending, which is hereby incorporated by reference in its entirety into this specification.

BACKGROUND OF THE INVENTION

Dispensing bottles or containers are widely used to store a fluid medium such as hair shampoo or hair conditioner for use by a person. Some conventional dispensing bottles employ a spout that is pushed downward to dispense the fluid medium stored in the dispensing bottle. Some conventional dispensing bottles employ an opening that allows the dispensing bottle to be re-filled. Such conventional dispensing bottles have several drawbacks. By way of example only, the spouts of such conventional dispensing bottles are accidentally depressed causing the dispensing of unwanted fluid medium.

SUMMARY OF THE INVENTION

One object of the present invention was to develop a dispensing bottle that employs a spout that cannot be depressed during non-use thereby avoiding accidental dispensing of the fluid medium.

Another object of the present invention was to develop a dispensing bottle that employs a spout that cannot be depressed and covers a re-fill plug.

The present invention is a dispensing bottle for storing and dispensing a fluid medium. In one embodiment, the dispe nsing bottle comprises a container comprising a cavity for storing the fluid medium. The dispensing bottle further comprises a cap engaged with the container. The cap comprises a first portion and a second portion comprising a top surface disposed above the first portion. The dispensing bottle further comprises a pump engaged with the first portion of the cap and substantially disposed within the cavity. The dispensing bottle further comprises a spout engaged with the pump and extending outside of the cap. In operation, the spout is moveable between an open position where the spout extends away from the cap so the fluid medium may be dispensed by depressing the spout and a closed position where the spout is disposed slightly above or touching the top surface of the second portion of the cap to prevent downward movement of the spout and accidental dispensing of the fluid medium.

BRIEF DESCRIPTION OF THE DRAWINGS

The following description of the invention will be more fully understood with reference to the accompanying drawings in which.

DESCRIPTION OF THE INVENTION

Figure 1:
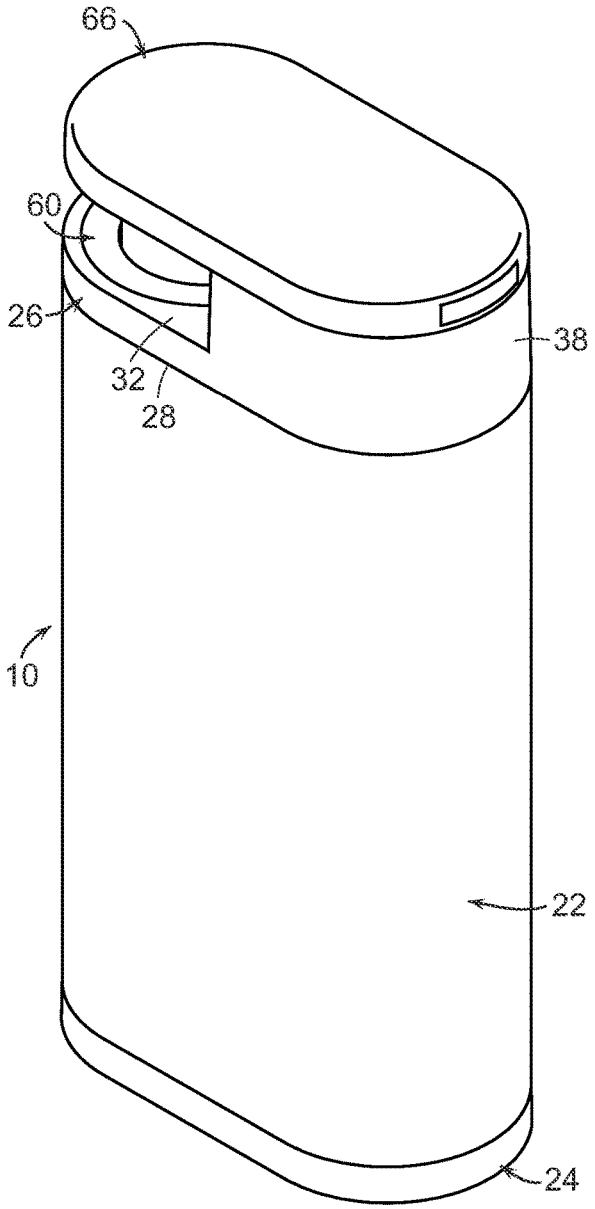
FIG. 1 is a perspective view of a dispensing bottle according to the present invention shown in a closed position where a spout covers a re-fill plug.
Figure 2:
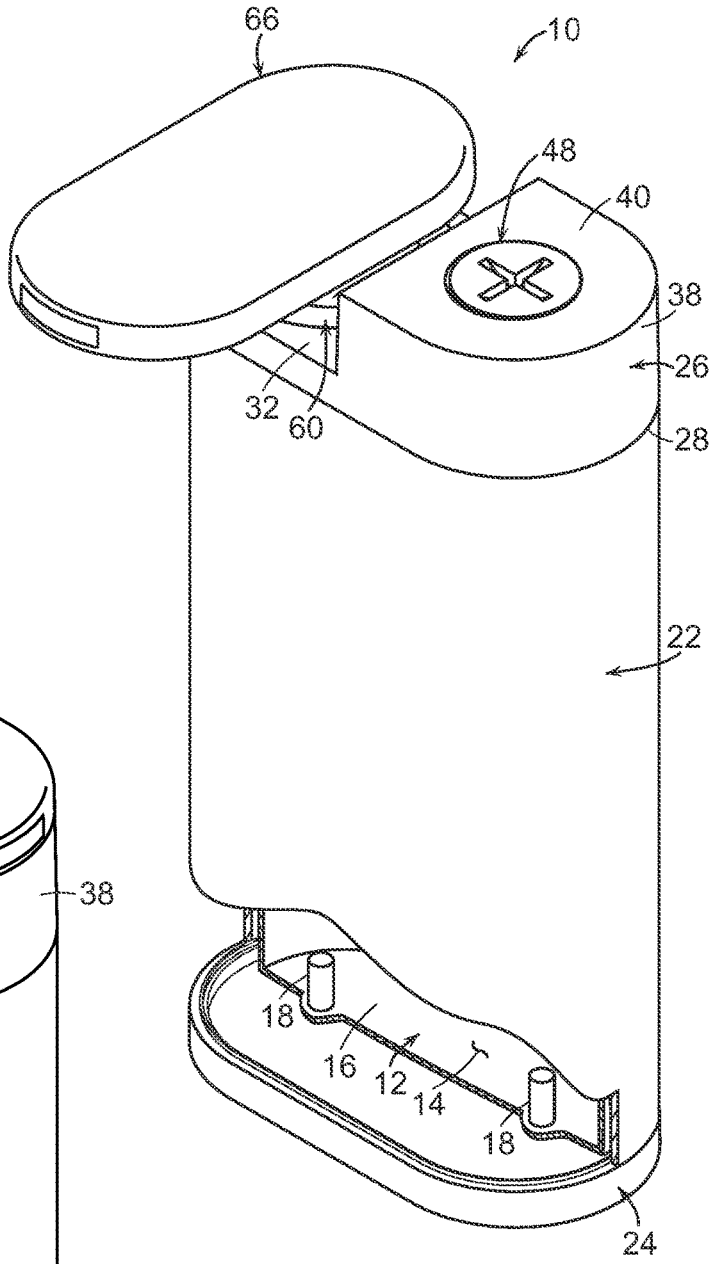
FIG. 2 is a perspective view of the dispensing bottle shown in an open position where the spout is rotated away from the re-fill plug for dispensing fluid medium by depression of the spout.

Referring to FIGS. 1 and 2, the present invention is a dispensing bottle 10 that may be used to store and dispense fluid mediums such as hair shampoo and hair conditioner. Dispensing bottle 10 generally comprises a container or cup 12 comprising a cavity 14 to store fluid medium (not shown), and a cap 26 engaged with container 12. Cap 26 generally comprises a base portion 28, a first portion 32, and a second portion 38 extending above first portion 32. Second portion 38 comprises a top surface 40 which in the embodiment shown is substantially flat. Dispensing bottle 10 further comprises a pump 52 (not shown) substantially disposed within cavity 14 and engaged with cap 26 by a pump cup 60. Dispensing bottle 10 further comprises a spout or actuator 66 engaged with pump 52, and a re-fill plug 48 removably engaged with flat top surface 40 of second portion 38 of cap 26 that can be removed for filling of container 12 with fluid medium. Dispensing bottle 10 further comprises a sleeve 22 disposed about container 12 and a base 24 that is engaged with container 12 by a plurality of screws 46 (not shown) that engage with a corresponding boss 18 extending upward from floor 16 of container 12. Spout 60 is rotatable or moveable between an open or dispensing position (FIG. 1) where spout 66 extends away from cap 26 so the fluid medium may be dispensed by depressing spout 66 and a closed or stored position where spout 66 is slightly above or touching top surface 40 of second portion 38 of cap 26 and re-fill plug 48, and spout 66 cannot be depressed to release undesired fluid medium.

Figure 3:
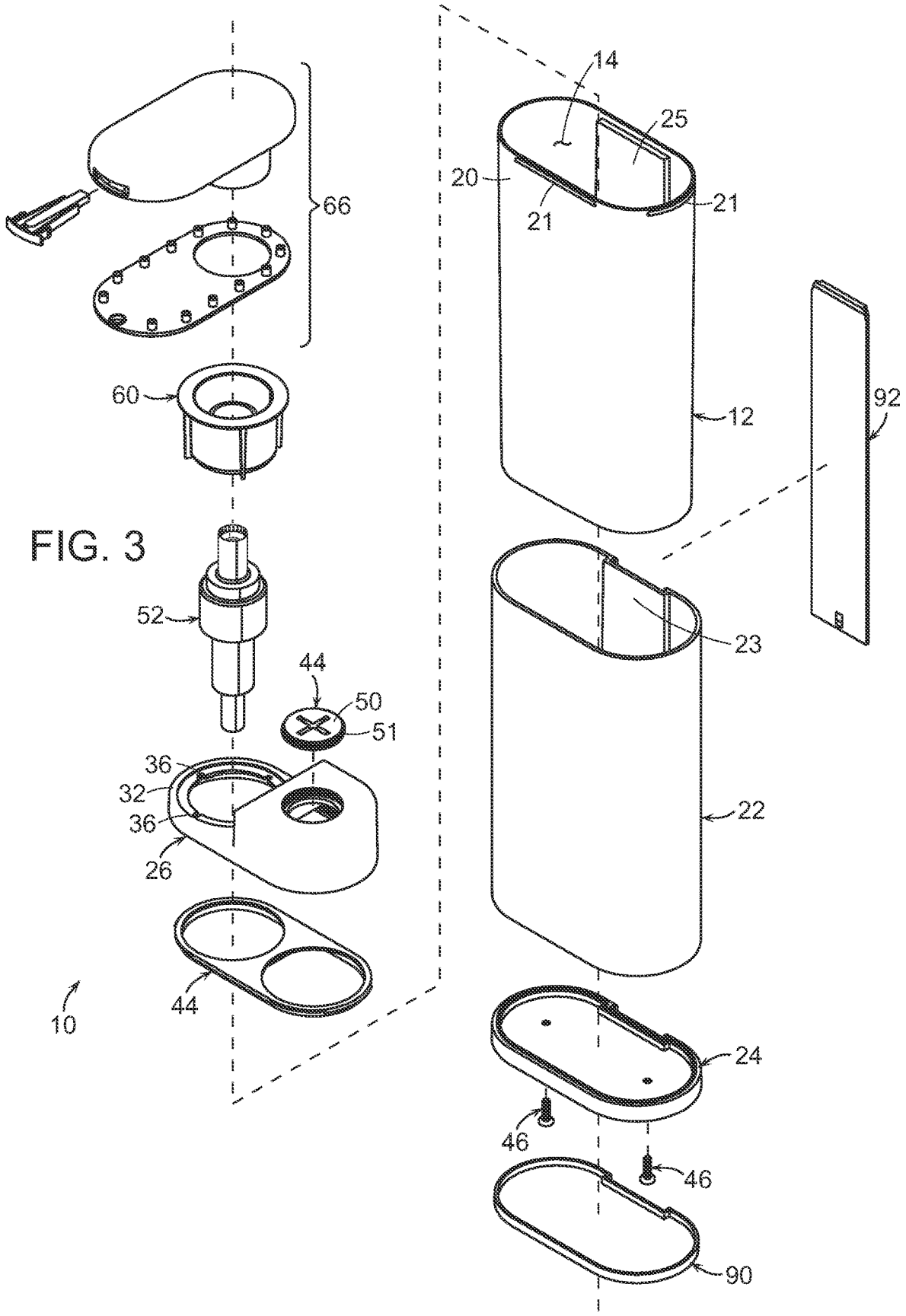
FIG. 3 is an exploded view of the dispensing bottle.
Figure 7:
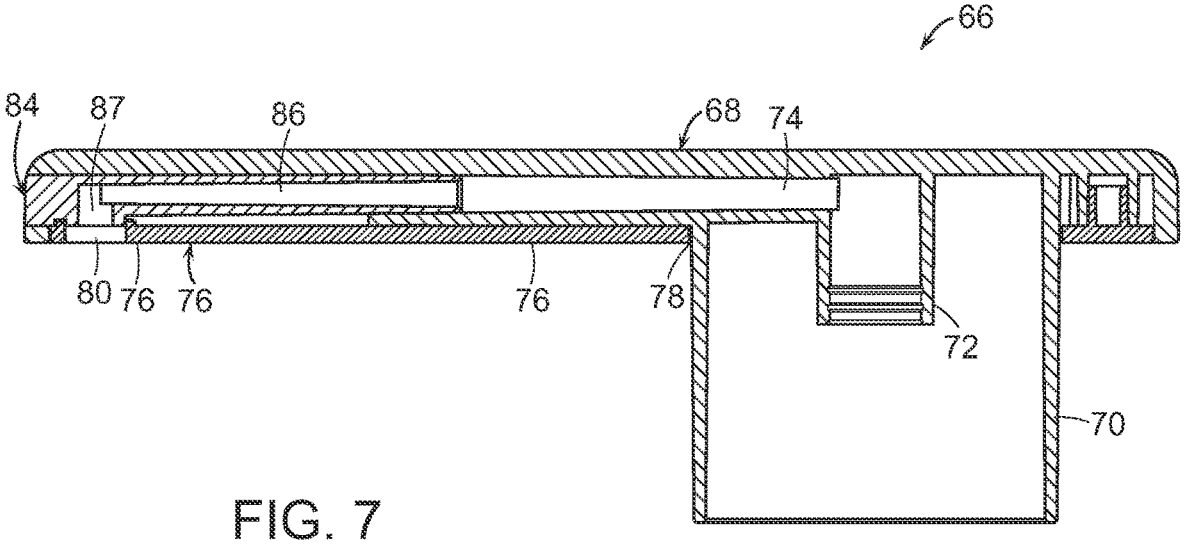
FIG. 7 is a perspective view of the spout.
Figure 8:
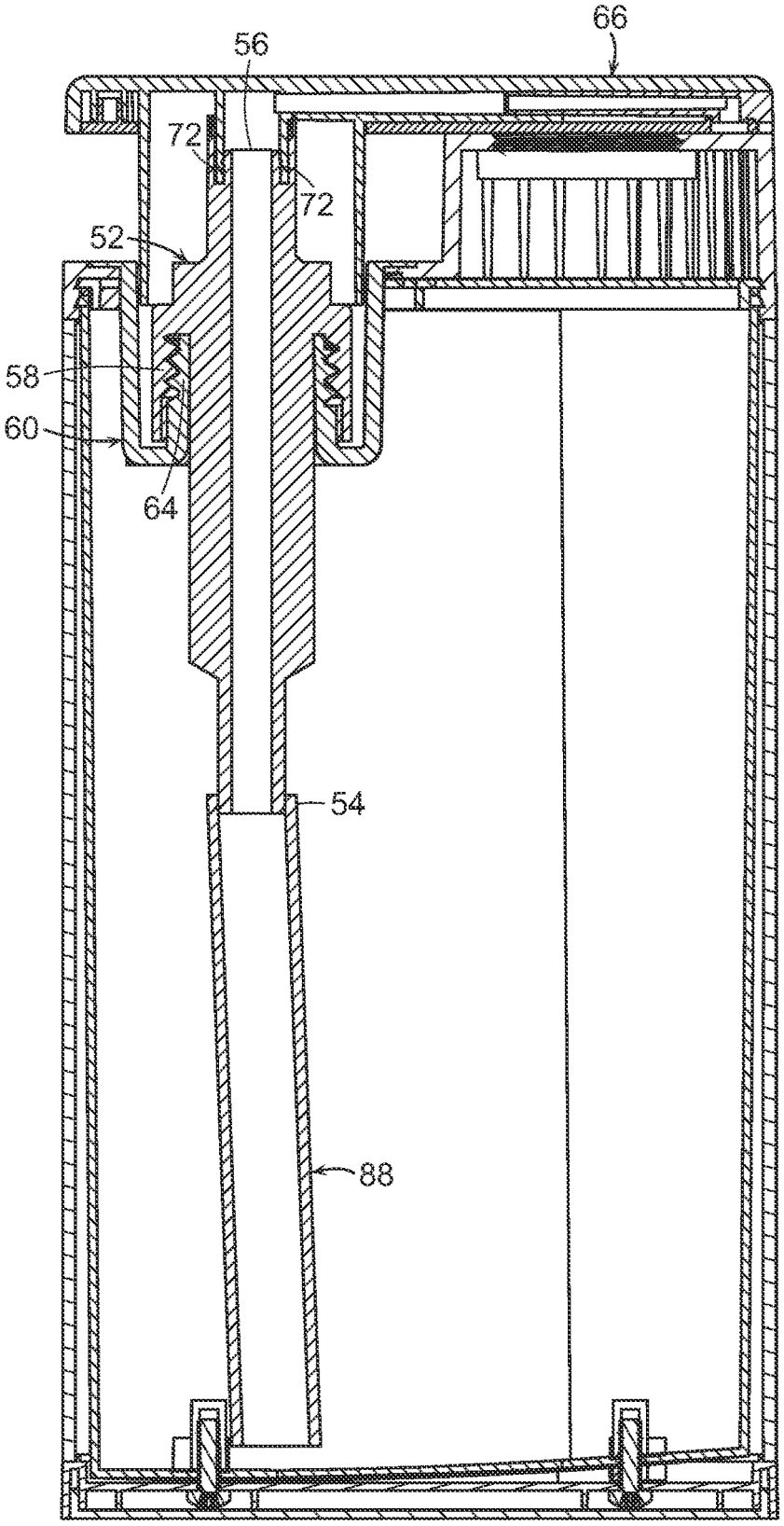
FIG. 8 is a cross-section view of the dispensing bottle.
Figure 9:
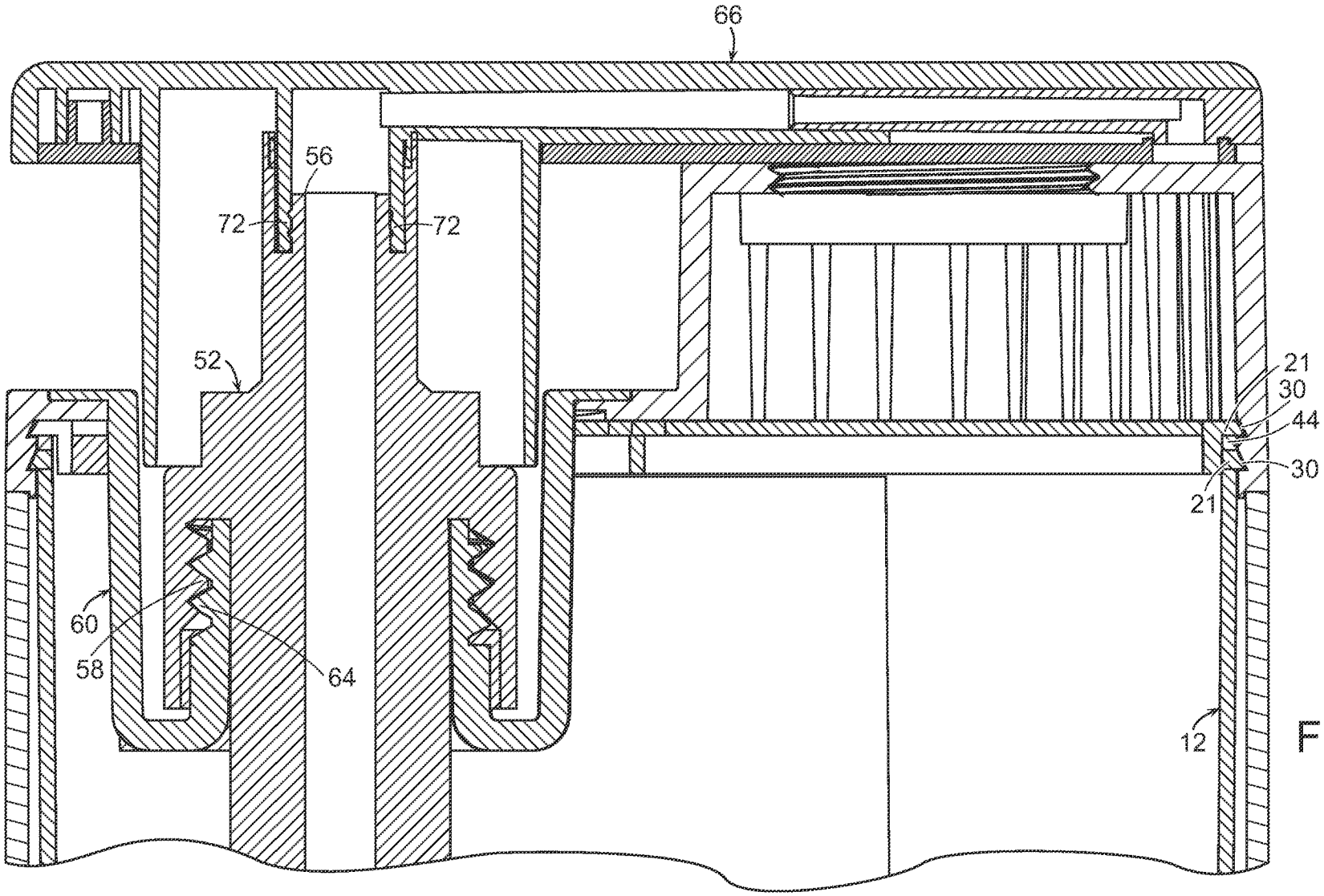
FIG. 9 is an enlarged view of the upper portion of the dispensing bottle of FIG. 8.

Referring to FIG. 3, where an exploded view of dispensing bottle 10 is illustrated. Shown is container 12, cap 26, base 24, sleeve 22, pump 52, pump cup 60, spout or actuator 66, and re-fill plug 44 as mentioned above. Base 24 is engaged with container 12 by conventional means such as screws 46 that engage with bosses 18 (FIGS. 1, 7, and 8) of container 12 to secure sleeve 22 there between. A cover 90 is engaged with base 22 to hide screws 46 by conventional means such as a snap type engagement. Container 12 comprises an upper end portion 20 and a plurality of protrusion snaps 21 that along with a gasket 44 engages with channel snaps 30 (FIGS. 5, 8 and 9) disposed about base portion 28 of cap 26. As discussed before, cavity 14 of container 12 stores the fluid medium (not shown). In the embodiment shown, cavity 14 can retainer about 500 ml of the fluid medium. Pump cup 60 comprises a plurality of male protrusions 62 that engage with female receptacles 36 of first portion 32 of cap 26 to secure pump cup 60 to cap 26. As shown by FIGS. 8 and 9, pump cup 60 comprises a threaded portion 64 that engages with threaded portion 58 of pump 52 (to be described). Re-fill plug 48 comprises a top surface 50 which in the embodiment shown is a substantially flat surface and a threaded portion 52 that removably engages with an opening 34 (to be described) of cap 26. Container 12 further comprises a wall mount 92 that removably engages with an indentation 23 of sleeve 22 by conventional means such as a snap type engagement. Indentation 23 engages with an indentation 25 of container 12 when sleeve 12 is disposed about container 12. Container 12, base 24, sleeve 66, pump cup 60, cover 90 and wall mount 92 may be made from a variety of materials such as plastic and can be fabricated by conventional means such as injection molding.

With continued reference to FIGS. 3, 8 and 9, pump 52 comprises a body 50, an inlet end portion 52, and an outlet end portion 54. Inlet end portion 52 is engaged with neck portion 70 of spout 66. Outlet end portion 54 is engaged with a straw 88 (not shown) that extends to the bottom of container 12 to collect substantially all of the fluid medium. As mentioned before, pump 52 comprises a threaded portion 58 that engages with threaded portion 64 of pump cup 60 to secure pump 52 to pump cup 60. Pump 48 is available from many sources such as Berlin Packaging, 525 West Monroe Street, Chicago, Ill. 60661, White PP Plastic Smooth Lotion Pump, Item No. 2167C66WHT; and online at https://www.berlinpackaging.com/2167c66wht-24-410-white-pp-plastic-smooth-lotion-pumps.

Figure 4:
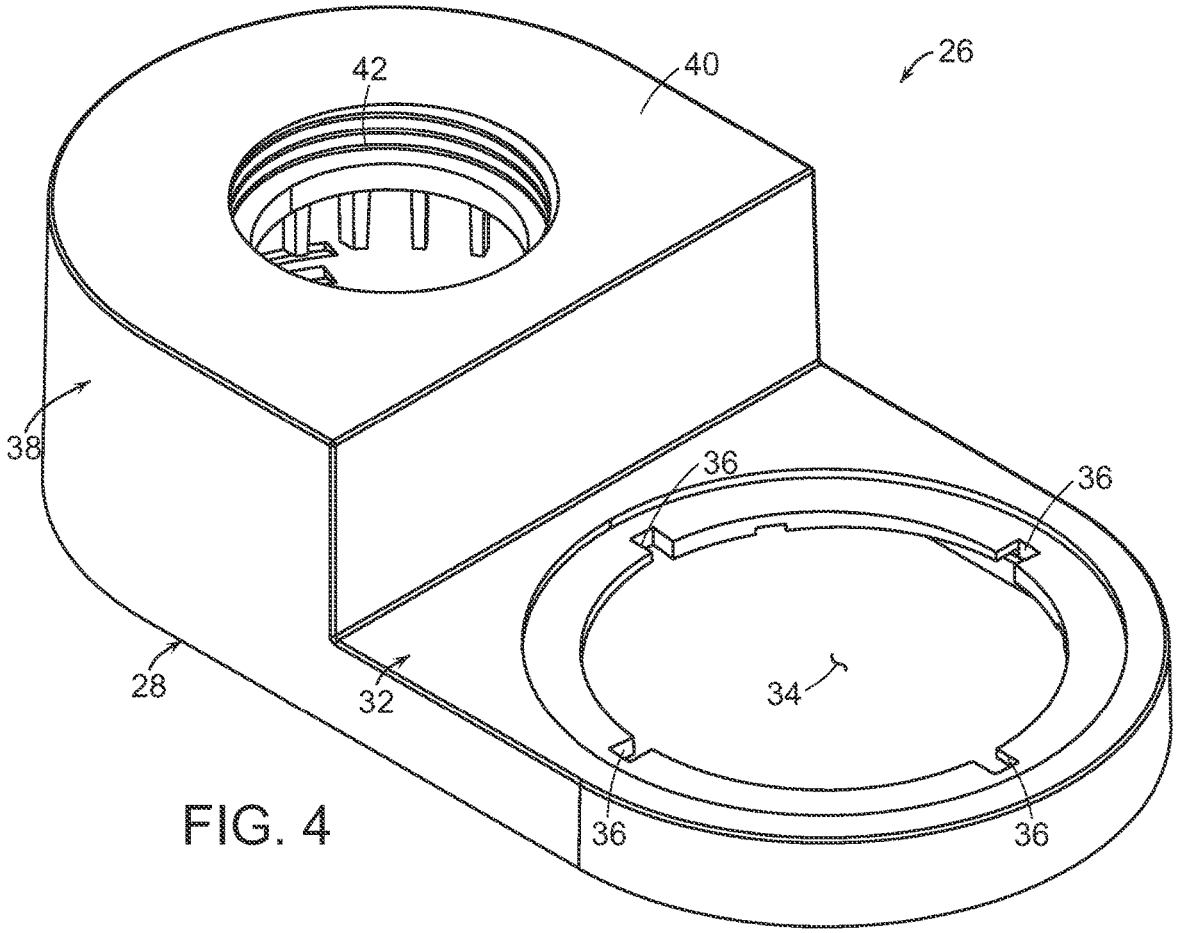
FIG. 4 is a perspective view of the cap.
Figure 5:
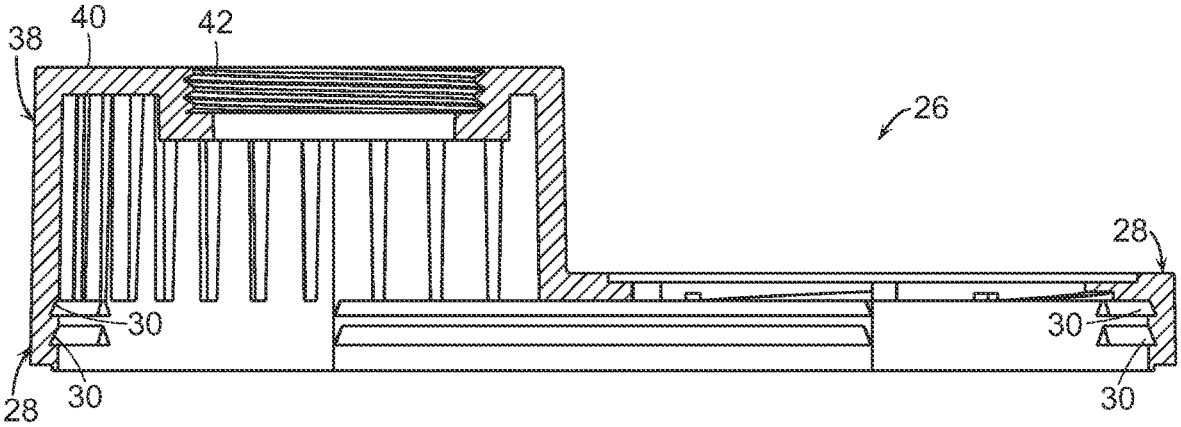
FIG. 5 is a cross-section view of the cap.
Figure 6:
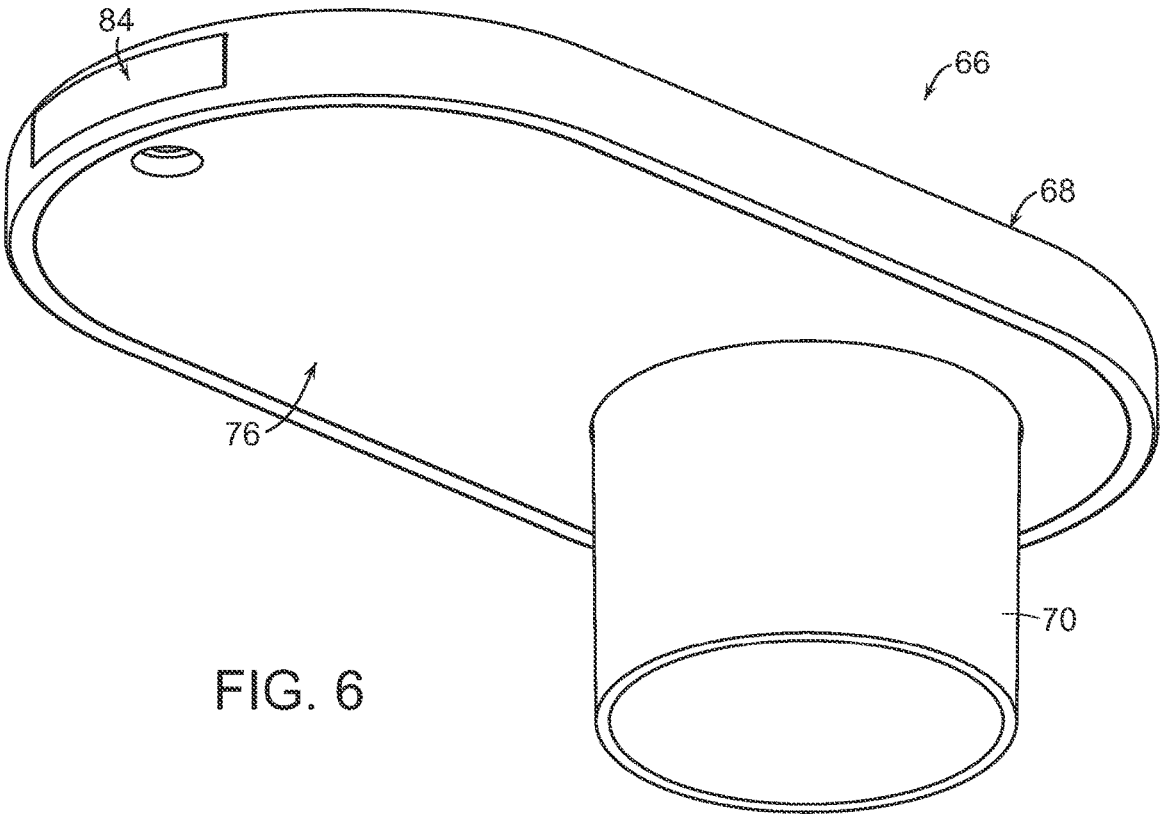
FIG. 6 is a perspective view of the spout.

With references to FIGS. 4 and 5, where a perspective and cross-section view of cap 26 is shown. As mentioned before, cap 26 generally comprises a base portion 28, a first portion 32 and a second portion 38 extending upward from base 32 and above first portion 32. First portion 32 comprising an opening 34 that allows insertion of pump 52 into container 12. As mentioned before cap 26 comprises female receptacles 36 disposed about opening 34 that engage with male protrusions 62 of pump cap 60. Second portion 38 extends upward from base portion 28 above first portion 32 and comprises a top surface 40 which in the embodiment shown is a flat surface and a threaded opening 42 that removably engages with threaded portion 51 of re-fill plug 48. In the embodiment shown, top surface 40 surrounding opening 42 is substantially planar with top surface 50 of re-fill plug 48 when re-fill plug 48 is fully threaded into opening 42. Top surface 40 prevents spout or actuator 66 from any downward movement in the stored position (FIG. 1) thereby preventing any unwanted spillage of fluid medium. Cap 26 may be made from a variety of materials such as plastic and can be fabricated by conventional means such as injection molding.

With reference to FIGS. 6 and 7-9, spout or actuator 66 generally comprises a body 68, a cover 76 engaged with the bottom of body 68, and a flow insert 82 to direct the flow of fluid downward from spout 66. Body 68 comprises a neck portion 70. Body 68 further comprises an inlet end portion 72 that engages with the outlet end portion 56 of pump 52 that allows spout 66 to be depressed downward to dispense fluid medium and returned upward to a maximum stroke height. Body 68 further comprises a channel 74 to allow the passage of fluid medium thru spout 66 from pump 52 to flow insert 84. Flow insert 84 comprises a channel 86 to carry the fluid medium and an outlet opening 87. Cover 76 comprises a bottom surface 76 which in the embodiment shown is a substantially flat surface, a neck opening 78, and an outlet opening 80 aligned with outlet opening 87 of flow insert 84 to expel the fluid medium downward. The height of second portion 38 above first portion 32 of cap 26 is the same or slightly less than the maximum stroke height of spout 66 plus tolerances so that bottom surface 76 of spout 66 is slightly above or in contact with top surface 40 of second portion 30 to prevent any unintentional depression of spout 66 and fluid medium during storage. Bottom surface 76 of spout 66 and top surface 40 of second portion 30 may take other shapes and designs other than a flat surface to allow the top surface of second portion 30 to prevent depression of spout 66. By way of example only, protrusions may be provided on both flat bottom surface 76 of spout 66 and flat surface 40 of second portion 30. However, having flat surfaces has the advantage of completely covering re-fill plug 48 during non-use. Body 68, flow insert 84, and cover 76 may be made from a variety of materials such as plastic and can be fabricated by conventional means such as injection molding.

Referring to FIG. 8 that shows a cross section view of dispensing bottle 10. Dispensing bottle 10 further comprises a straw 88 that is engaged with inlet end portion 54 of pump 52. Straw 88 extends to the bottom of container 12 so that pump 52 can extract most of the fluid medium from container 12. Straw 88 is made of plastic tubing and is widely available.

The foregoing description is intended primarily for purposes of illustration. This invention may be embodied in other forms or carried out in other ways without departing from the spirit or scope of the invention. Modifications and variations still falling within the spirit or scope of the invention will be readily apparent to those of skill in the art.

What is claimed:

1. A bottle for storing and dispensing a fluid medium comprising:

a container comprising a cavity for storing the fluid medium;

a cap engaged with said container; said cap comprising a first portion and a second portion comprising a top surface disposed above said first portion; said cap further comprises a first opening disposed in said first portion in communication with said cavity and a second opening disposed in said top surface of said second portion and in communication with said cavity;

a pump engaged with said first portion of said cap and substantially disposed within said cavity;

a spout engaged with said pump and extending outside of said cap;

said spout being moveable between an open position where said spout extends away from said cap so the fluid medium may be dispensed and a closed position where said spout is disposed slightly above or in contact with said top surface of said second portion to prevent downward movement of said spout.

2. The bottle of claim 1, wherein said top surface of said second portion of said cap is substantially flat.

3. The bottle of claim 2, wherein said spout comprises a substantially flat bottom surface and an outlet opening in said flat bottom surface to dispense the fluid medium directly downward.

4. The bottle of claim 3, further comprising a re-fill plug removably engaged with said second opening.

5. The bottle of claim 4, where said re-fill plug comprises a substantially flat top surface; in said closed position said substantially flat bottom surface of said spout is slightly above or contact with said top surface of said second portion of said cap and covers said re-fill plug.

* * * * *